US011819129B1

(12) United States Patent
Pryor et al.

(10) Patent No.: US 11,819,129 B1
(45) Date of Patent: Nov. 21, 2023

(54) INTERCHANGEABLE, DUAL-SIDED MEDIA EASEL AND ASSOCIATED METHOD(S)

(71) Applicant: Allied Plastics Co., Inc., Jacksonville, FL (US)

(72) Inventors: Steven Pryor, St Augustine, FL (US); Lawrence Berger, Jacksonville, FL (US); Griffin Berger, Jacksonville, FL (US)

(73) Assignee: Allied Plastics Co., Inc., Jacksonville, FL (US)

( * ) Notice: Subject to any disclaimer, the term of this patent is extended or adjusted under 35 U.S.C. 154(b) by 31 days.

(21) Appl. No.: 17/649,036

(22) Filed: Jan. 26, 2022

(51) Int. Cl.
*A47B 97/04* (2006.01)

(52) U.S. Cl.
CPC ..... *A47B 97/04* (2013.01)

(58) Field of Classification Search
CPC ..... B43L 1/00; A47B 97/04; F16M 11/42
USPC ..... 248/441.1, 443, 442.32, 447; 434/408
See application file for complete search history.

(56) References Cited

U.S. PATENT DOCUMENTS 1,810,826 A * 6/1931 Gray ..... G09F 5/02 222/173
2,485,517 A * 10/1949 Vaule ..... A47B 97/08 434/420
4,971,284 A * 11/1990 Curry ..... A47B 97/04 248/165
5,941,713 A * 8/1999 Wayner ..... B43L 1/06 434/408
7,337,569 B2 * 3/2008 Glass ..... G09F 15/0062 116/63 P
11,089,873 B1 * 8/2021 Dawson ..... B60B 19/12
2001/0054674 A1 * 12/2001 Turner ..... A47B 97/04 248/460
2018/0012527 A1 * 1/2018 Struhl ..... G09F 15/0056
2018/0352957 A1 * 12/2018 Avallon ..... A47B 3/00
2020/0342794 A1 * 10/2020 Dalton ..... A47B 97/08

* cited by examiner

*Primary Examiner* — Muhammad Ijaz
(74) *Attorney, Agent, or Firm* — Ashkan Najafi

(57) ABSTRACT

An easel selectively supports a variety of media and includes a centrally registered longitudinal axis, a first display section oriented along a first plane obliquely angled to the centrally registered longitudinal axis, a second display section opposed from the first display section and oriented along a second plane obliquely angled to the axis, a plurality of storage shelves positioned between the first display section and the second display section, and a plurality of media display members removably engaged with the first display section and the second display section, respectively, and positioned parallel to the first plane and the second plane, respectively. The media display members are interchangeably and slidably engaged with each of the first display section and the second display section. The first display section is pivotally coupled to the second display section and pivoted about a fulcrum axis perpendicular to the axis.

10 Claims, 6 Drawing Sheets

INTERCHANGEABLE, DUAL-SIDED MEDIA EASEL AND ASSOCIATED METHOD(S)

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to easels and, more particularly, to a portable, interchangeable, and dual-sided easel configured to selectively support a variety of media on anterior and posterior display sides of the easel.

Prior

Display boards such as dry-erase boards or "whiteboards" are commonly used for the presentation of graphics and written material during presentations. The majority of dry-erase boards consist of a writing surface and a surrounding frame, and are designed to be permanently hung or mounted to a wall. Permanently mounted boards are satisfactory for use in rooms where a constant need exists for the board, such as in classrooms. However, many presentations take place where a permanently installed board may not be available or desired (such as for aesthetic considerations). In such situations, at least the temporary availability of a board is desired.

There are examples of dry-erase boards that are portable. The portable dry-erase boards have easel stand-like legs incorporated into their design. Unfortunately, the portable boards tend to be bulky, complicated to set up, relatively unsteady during use, and provide limited display or writing space. Further, the portable boards are not very versatile, in that they can only be easily used with the incorporated legs and are therefore not readily adaptable to use with different support structures that may be available, such as easel stands (that may be sturdier than the incorporated legs), tabletops (that may be more appropriate in some applications), or available wall mounts. For example, many rooms that are used periodically for presentations or meetings, although not having permanently mounted boards, do have easel stands readily available. Commonly available are easel stands of the type designed to hold large pads of paper ("easel pads"), where individual sheets may be torn off to reveal a new sheet, or alternately flipped over the top of the pad as a "flip chart."

Easel stands maintain the easel pads on the easel stand in a variety of manners. For example, a tray may protrude from the easel stand to support the easel pad from the bottom, such that the top of the pad simply reclines against the easel stand. Some easel stands have posts extending from an upper portion of the easel stand that are designed to engage pre-punched holes in a top portion of the easel pad. After the pad is positioned on the posts, a retaining member typically engages the ends of the posts to secure the pad. Other easel stands have a clamping member for accepting the top edge of an easel pad. The clamping members include spring-type clamps, manual clamps, and gravity-aided cam mechanisms, for example. Usually, clamping members have a capacity limited to dimensions of a typical easel pad thickness (e.g., approximately ¼ to ⅜ inch thick).

Accordingly, a need remains for an improved easel in order to overcome at least one aforementioned shortcoming. The exemplary embodiment(s) satisfy such a need by providing a portable, interchangeable, and dual-sided easel that is convenient and easy to use, lightweight yet durable in design, versatile in its applications, and designed for portable, interchangeable, and dual-sided easel configured to selectively support a variety of media on anterior and posterior display sides of the easel.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a portable, interchangeable, and dual-sided easel configured to selectively support a variety of media on anterior and posterior display sides of the easel. These and other objects, features, and advantages of the non-limiting exemplary embodiment(s) are provided by an easel configured to selectively support a variety of media. Such an easel includes a centrally registered longitudinal axis, a first display section oriented along a first plane obliquely angled to the centrally registered longitudinal axis, a second display section opposed from the first display section and oriented along a second plane obliquely angled to the centrally registered longitudinal axis, a plurality of storage shelves positioned between the first display section and the second display section, and a plurality of media display members removably engaged with the first display section and the second display section, respectively, and positioned parallel to the first plane and the second plane, respectively. Advantageously, the media display members are interchangeably and slidably engaged with each of the first display section and the second display section. Advantageously, each of the first plane and the second plane are equidistantly offset from the centrally registered longitudinal axis. Advantageously, the first display section is pivotally coupled to the second display section and pivoted about a fulcrum axis perpendicular to the centrally registered longitudinal axis.

In a non-limiting exemplary embodiment, each of the first display section and the second display section is independently pivotal along a first arcuate path and a second arcuate path, respectively, relative to the fulcrum axis.

In a non-limiting exemplary embodiment, the first display section includes a plurality of first rectilinear vertical legs equidistantly offset at opposed sides of the centrally registered longitudinal axis, a plurality of first rectilinear horizontal legs having axially opposed ends connected to the plurality of first rectilinear vertical legs, respectively, and a plurality of first guide rails statically coupled to axially opposed ends of the plurality of first rectilinear vertical legs, respectively. Advantageously, the plurality of first guide rails are oriented parallel to the plurality of first rectilinear horizontal legs and orthogonal to the plurality of first rectilinear vertical legs. Advantageously, the plurality of first guide rails are spaced from the storage shelves.

In a non-limiting exemplary embodiment, the second display section includes a plurality of second rectilinear vertical legs equidistantly offset at opposed sides of the centrally registered longitudinal axis, a plurality of second rectilinear horizontal legs having axially opposed ends connected to the plurality of second rectilinear vertical legs, respectively, and a plurality of second guide rails statically coupled to axially opposed ends of the plurality of second rectilinear vertical legs, respectively. Advantageously, the plurality of second guide rails are oriented parallel to the plurality of second rectilinear horizontal legs and orthogonal to the plurality of second rectilinear vertical legs.

In a non-limiting exemplary embodiment, the plurality of first guide rails includes a first top guide rail and a first bottom guide rail. Notably, the plurality of second guide rails includes a second top guide rail and a second bottom guide rail. Advantageously, the first top guide rail is pivotally coupled to the second top guide rail, and the first bottom guide rail is spaced from the second bottom guide rail.

In a non-limiting exemplary embodiment, the easel further includes a plurality of casters attached to each of the first display section and the second display section.

In a non-limiting exemplary embodiment, the plurality of media display members include: a TV mount, a peg board, a dry-eraser board, a cork board, a white board, and a magnetic board.

The present disclosure further includes a method of utilizing an easel configured to selectively support a variety of media. Such a method includes the initial step of: providing an easel including a centrally registered longitudinal axis, a first display section oriented along a first plane obliquely angled to the centrally registered longitudinal axis, a second display section opposed from the first display section and oriented along a second plane obliquely angled to the centrally registered longitudinal axis, and a plurality of storage shelves positioned between the first display section and the second display section. Advantageously, each of the first plane and the second plane are equidistantly offset from the centrally registered longitudinal axis.

The method further includes the steps of: pivotally coupling the first display section to the second display section; providing and removably engaging a plurality of media display members with the first display section and the second display section, respectively; positioning the media display members parallel to the first plane and the second plane, respectively; interchangeably and slidably engaging the media display members with each of the first display section and the second display section; and pivoting the first display section, relative to the second display section, about a fulcrum axis perpendicular to the centrally registered longitudinal axis.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 2:
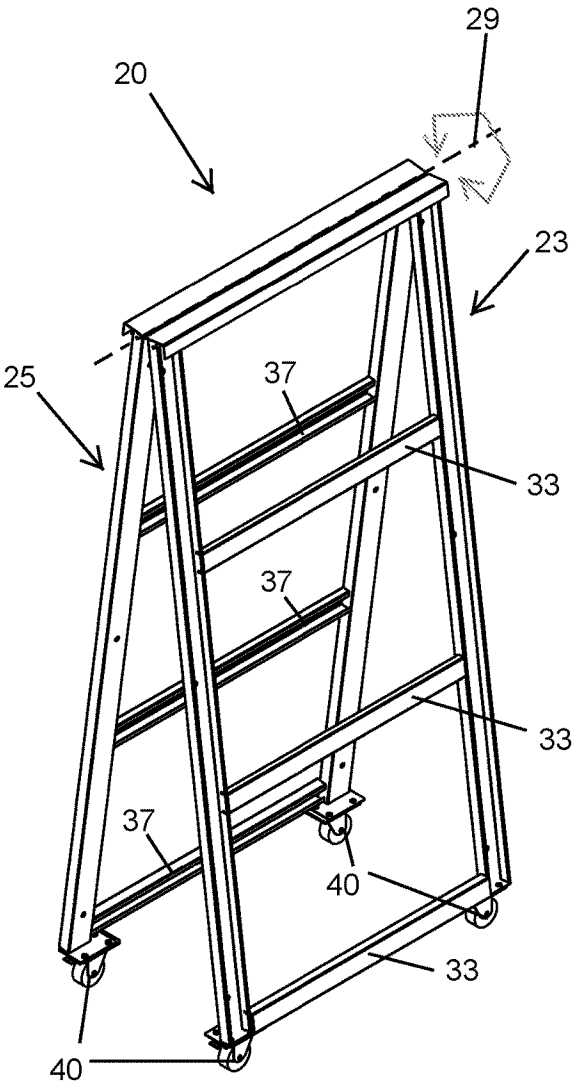
FIG. 2 is another perspective view of the easel shown in FIG. 1 without the media display surfaces, shelves, and selected frame members.
Figure 1:
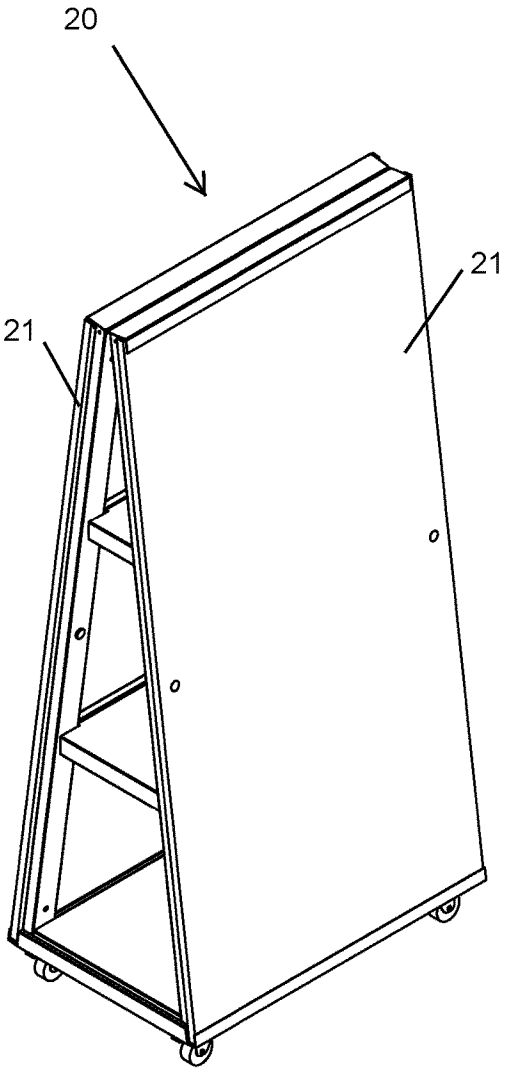
FIG. 1 is a perspective view of an interchangeable, dual-sided easel employing a plurality of media display surfaces, in accordance with a non-limiting exemplary embodiment of the present disclosure.
Figure 4:
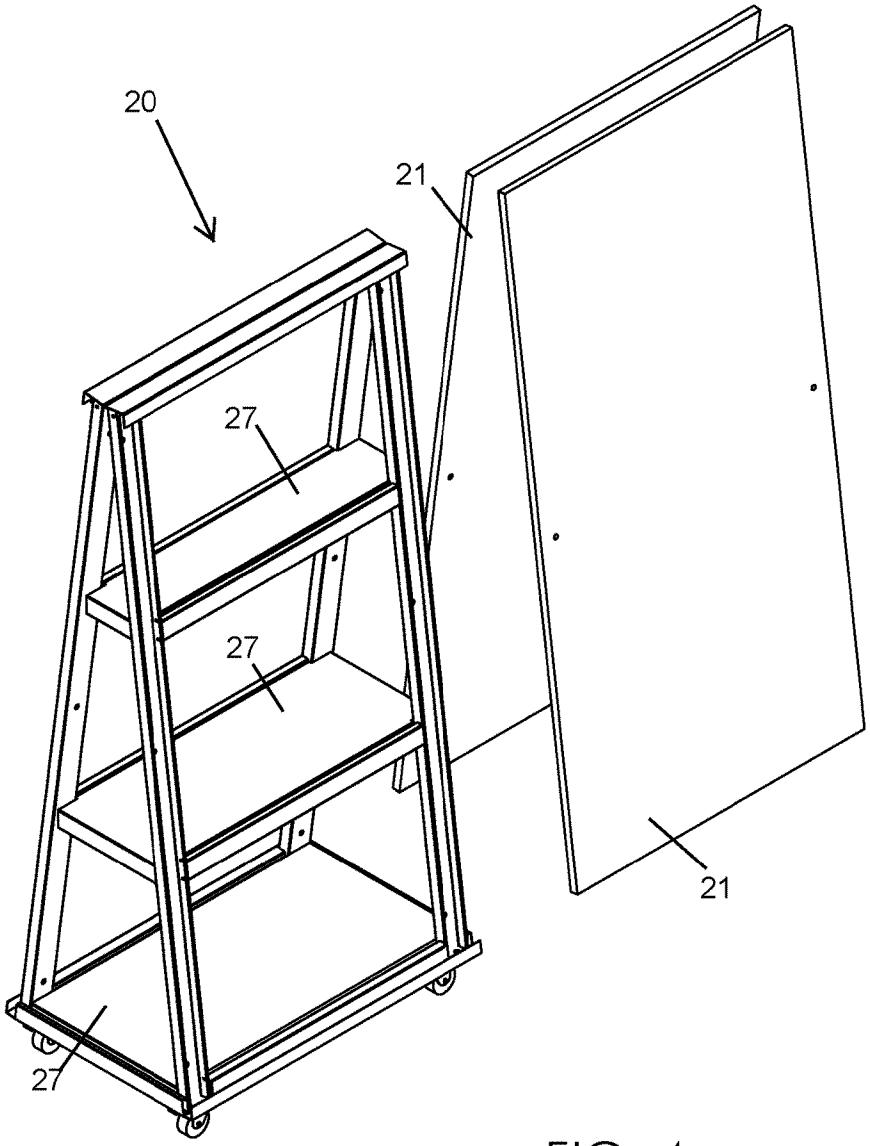
FIG. 4 is another perspective view of the easel shown in FIG. 3, wherein the media display surfaces are slidably disengaged from the first and second display sections.
Figure 3:
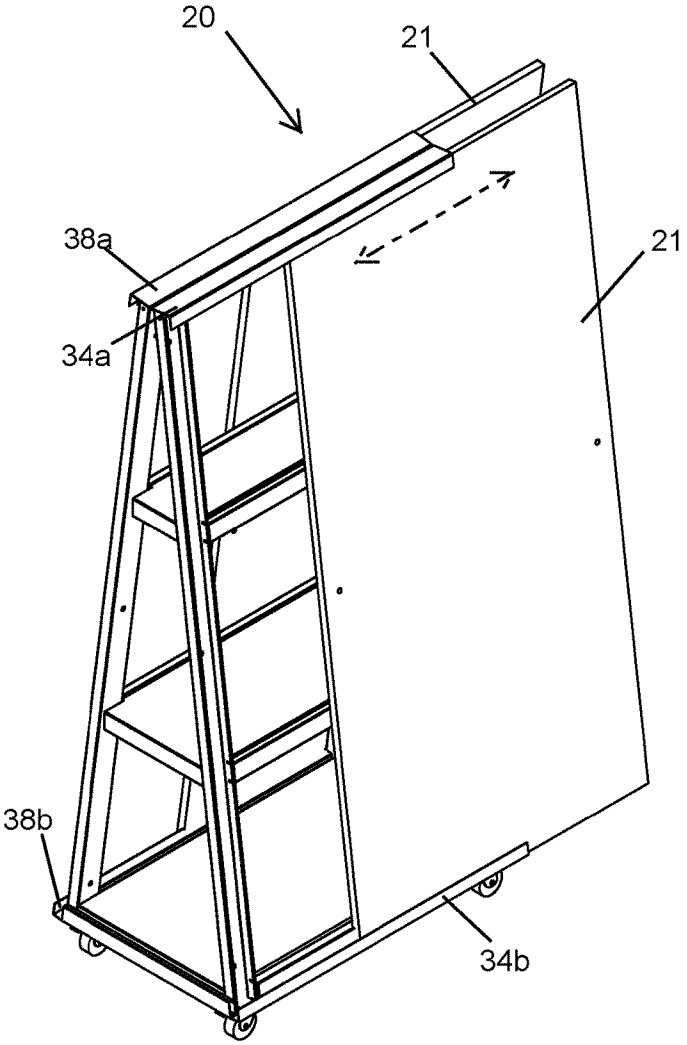
FIG. 3 is another perspective view of the easel shown in FIG. 1 wherein the media display surfaces are slidably displaced.
Figure 6:
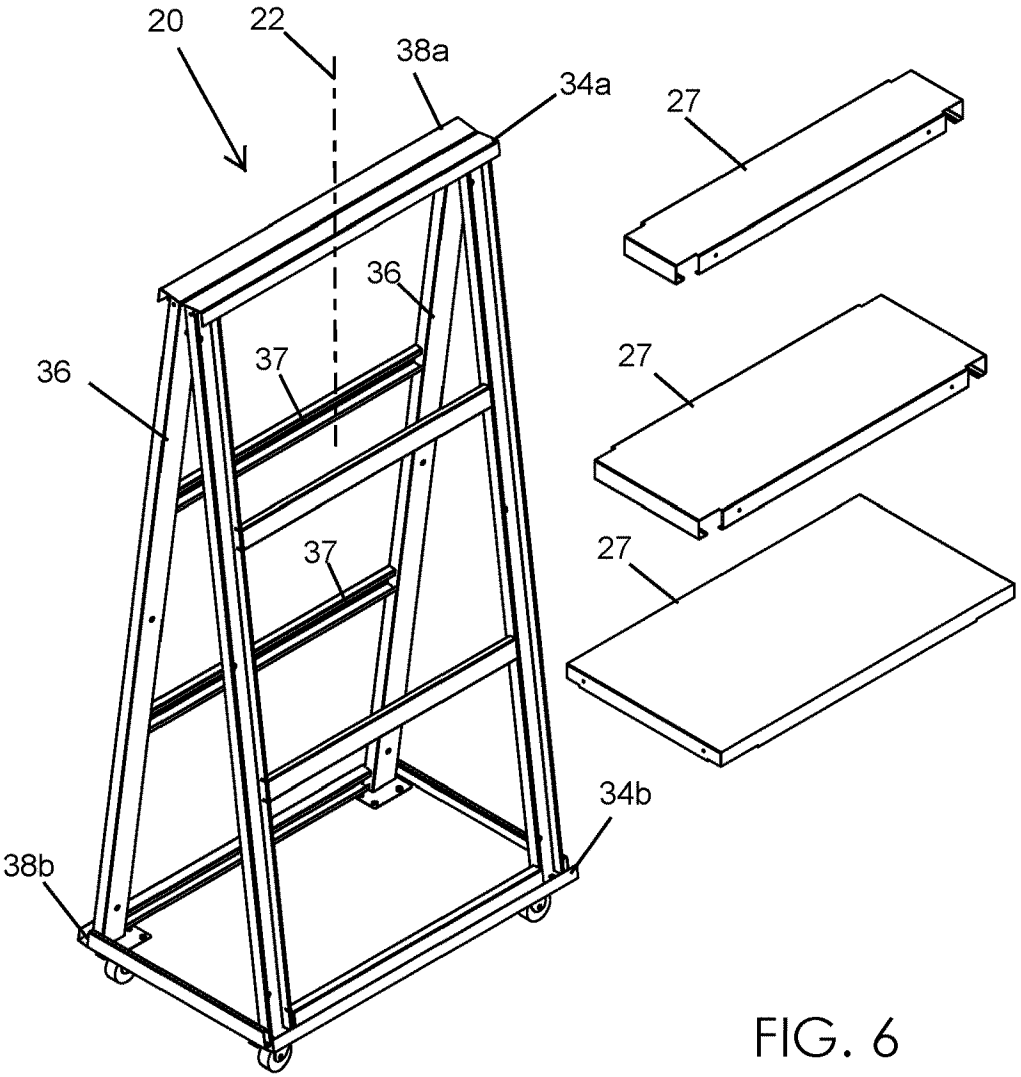
FIG. 6 is a partially exploded view showing the shelves disengaged from the easel frame.
Figure 5:
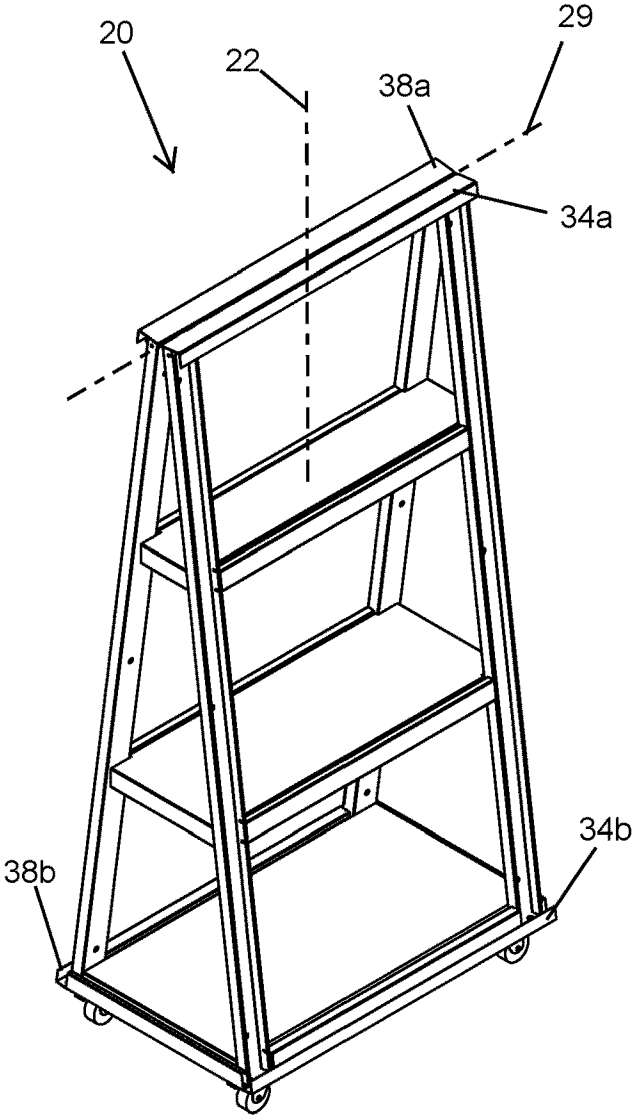
FIG. 5 is another perspective view showing the shelves engaged with the easel frame.
Figure 8:
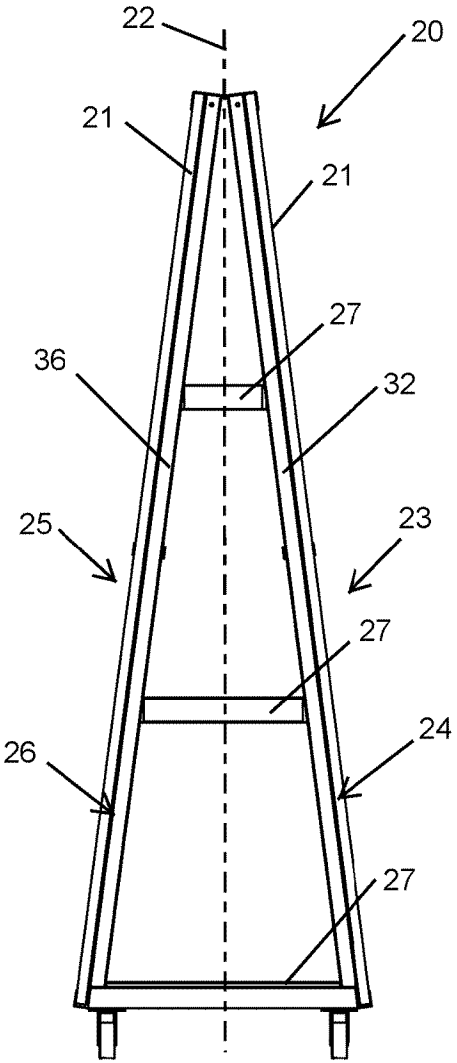
FIG. 8 is a side elevational view of the easel shown in FIG. 7.
Figure 7:
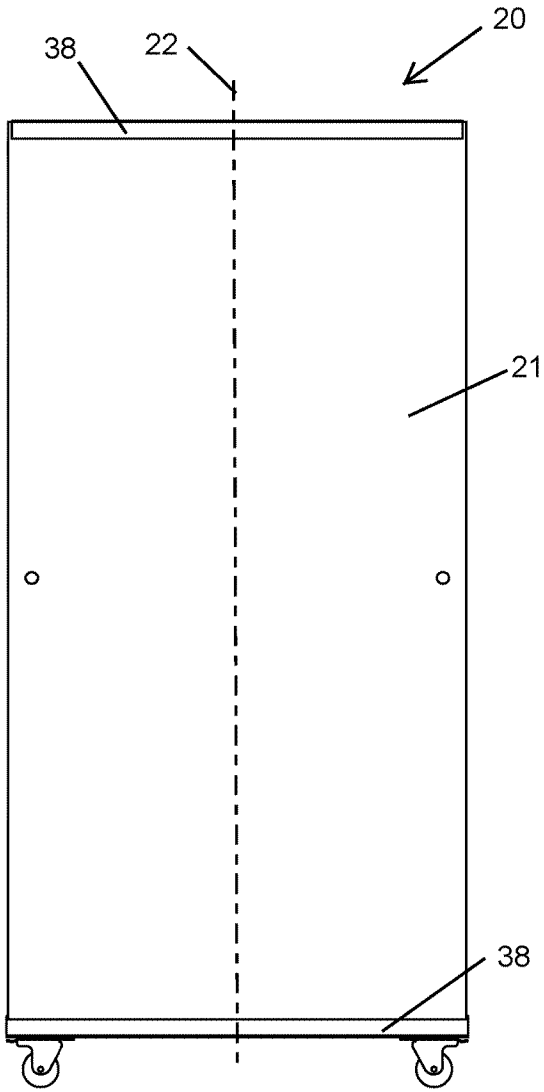
FIG. 7 is a front elevational view of the easel shown in FIG. 1.
Figure 10A:
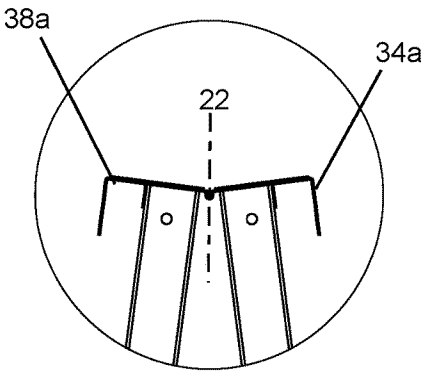
FIG. 10 is another side elevational view of the easel shown in FIG. 5.
Figure 11:
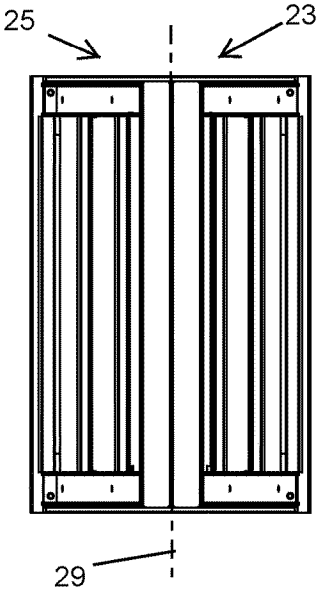
Figure 10:
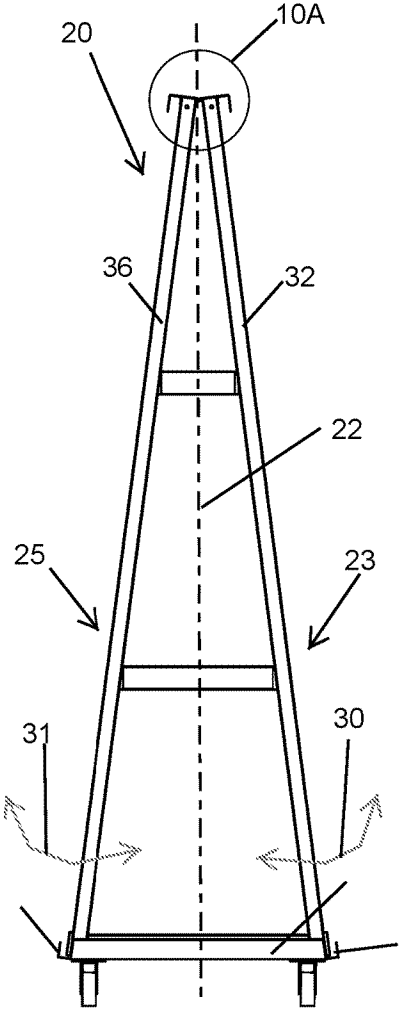
Figure 9:
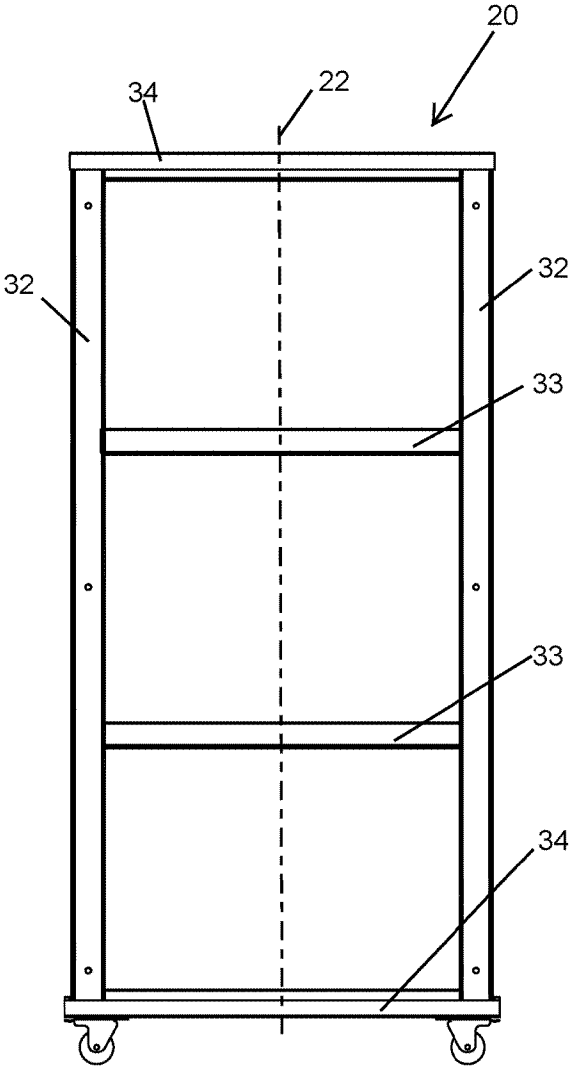
FIG. 9 is a front elevational view of the easel shown in FIG. 5.
Figure 12:
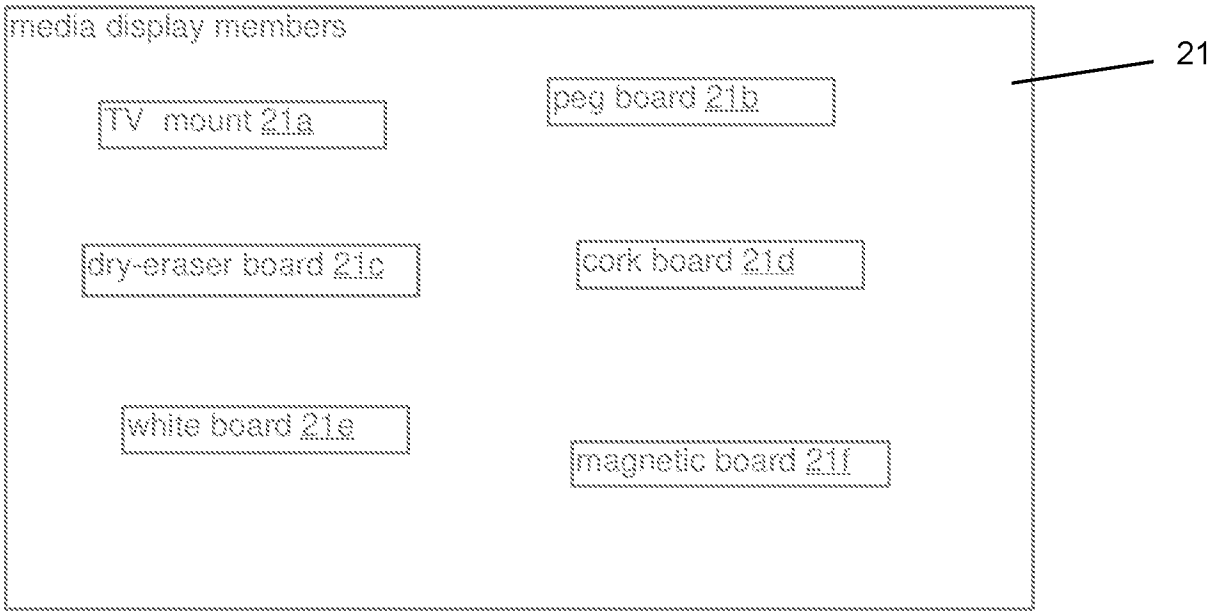

FIG. 10*a* is an enlarged view of section 10A shown in FIG. 10;

FIG. 11 is an enlarged bottom plan view of the easel shown in FIG. 10; and FIG. 12 is a block diagram illustrating the various types of media display members, which are interchangeably attached to the easel.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means ±15% of the numerical.

If used herein, "substantially" means largely if not wholly that which is specified but so close that the difference is insignificant.

The terms "media display surfaces," "media display members," and "boards" are interchangeably used throughout the present disclosure.

The non-limiting exemplary embodiment(s) is/are referred to generally in FIGS. 1-12 and is/are intended to provide a portable, interchangeable, and dual-sided easel 20 configured to selectively support a variety of media on anterior and posterior display sides of the easel 20. The mobile, interchangeable, dual-sided media easel 20 that has interior storage shelves 27 as well as a switchback interchangeable media display surface 21 system. The easel 20 is large enough to use as a partition and enable a user to quickly interchange a variety of media, while providing a quick assembly framing system.

In a non-limiting exemplary embodiment, a writing surface measuring 36-inch wide by 72-inch tall is provided. The writing surface may include two ¾-inch thick particle board sealed with premium high gloss dry-erase boards on both sides. Two presentation boards 21 are provided, each having two usable surfaces (front and back). A 2-mm PVC edge profile seals the boards for easy cleaning. Boards 21 secure to frame with quick connect fasteners for user friendly replacement.

In a non-limiting exemplary embodiment, a quick assembly frame system 20 is made of 18-gauge U-channel steel A-frame structure with 16-gauge support channels for easy media display member 21 switching.

In a non-limiting exemplary embodiment, three interior surface 27 areas are provided for storage. Each shelf 27 is formed from 18-gauge powder coated steel.

In a non-limiting exemplary embodiment, non-mar locking casters 40 allow for ease of movement on carpet and tile.

The present disclosure allows the end-user to swap out boards (media display surfaces 21) with ease. Once one side of a board wears down, the board can be reversed to expose the backside as a new surface. The interchangeable easel 20 allows a user to employ different board surfaces to accommodate various uses. For example, a user may employ: a tv mount, a peg board, a cork board, a white board, a magnetic board, and a variety of ¾-inch board surfaces, etc.

Referring to FIGS. 1-12 in general, the easel 20 is configured to selectively support a variety of media (e.g., media display surfaces 21 that hold TVs, presentation posters, etc.). Such an easel 20 includes a centrally registered longitudinal axis 22, a first display section 23 oriented along a first plane 24 obliquely angled to the centrally registered longitudinal axis 22, a second display section 25 opposed from the first display section 23 and oriented along a second plane 26 obliquely angled to the centrally registered longitudinal axis 22, a plurality of storage shelves 27 positioned between the first display section 23 and the second display section 25, and a plurality of media display members 21 removably engaged with the first display section 23 and the second display section 25, respectively, and positioned parallel to the first plane 24 and the second plane 26, respectively. Advantageously, the media display members 21 are interchangeably and slidably engaged with each of the first display section 23 and the second display section 25. Advantageously, each of the first plane 24 and the second plane 26 are equidistantly offset from the centrally registered longitudinal axis 22. Advantageously, the first display section 23 is pivotally coupled to the second display section 25 and pivoted about a fulcrum axis 29 perpendicular to the centrally registered longitudinal axis 22. Such a structural configuration yields the new, useful, and unpredicted result of succinctly and interchangeably switch out various media display members 21 without have to disassemble the easel 20.

In a non-limiting exemplary embodiment, each of the first display section 23 and the second display section 25 is independently pivotal along a first arcuate path 30 and a second arcuate path 31, respectively, relative to the fulcrum axis 29. Such a structural configuration yields the new, useful, and unpredicted result of folding the easel 20 to a compact position without having to disable any components thereof.

In a non-limiting exemplary embodiment, the first display section 23 includes a plurality of first rectilinear vertical legs 32 equidistantly offset at opposed sides of the centrally registered longitudinal axis 22, a plurality of first rectilinear horizontal legs 33 having axially opposed ends connected to the plurality of first rectilinear vertical legs 32, respectively, and a plurality of first guide rails 34 statically coupled to axially opposed ends of the plurality of first rectilinear vertical legs 32, respectively. Advantageously, the plurality of first guide rails 34 are oriented parallel to the plurality of first rectilinear horizontal legs 33 and orthogonal to the plurality of first rectilinear vertical legs 32. Advantageously, the plurality of first guide rails 34 are spaced from the storage shelves 27. Such a structural configuration yields the new, useful, and unpredicted result of providing both storage shelves 27 and media display members 21.

In a non-limiting exemplary embodiment, the second display section 25 includes a plurality of second rectilinear vertical legs 36 equidistantly offset at opposed sides of the centrally registered longitudinal axis 22, a plurality of second rectilinear horizontal legs 37 having axially opposed ends connected to the plurality of second rectilinear vertical legs 36, respectively, and a plurality of second guide rails 38 statically coupled to axially opposed ends of the plurality of second rectilinear vertical legs 36, respectively. Advantageously, the plurality of second guide rails 38 are oriented parallel to the plurality of second rectilinear horizontal legs 37 and orthogonal to the plurality of second rectilinear vertical legs 36. Such a structural configuration yields the new, useful, and unpredicted result of providing both storage shelves 27 and media display members 21.

In a non-limiting exemplary embodiment, the plurality of first guide rails 34 includes a first top guide rail 34*a* and a first bottom guide rail 34*b*. Notably, the plurality of second guide rails 38 includes a second top guide rail 38*a* and a second bottom guide rail 38*b*. Advantageously, the first top guide rail 34*a* is pivotally coupled to the second top guide rail 38*a*, and the first bottom guide rail 34*b* is spaced from the second bottom guide rail 38*b*. Such a structural configuration yields the new, useful, and unpredicted result of enabling articulation at the top end as needed.

In a non-limiting exemplary embodiment, the easel 20 further includes a plurality of casters 40 attached to each of the first display section 23 and the second display section 25. Such a structural configuration yields the new, useful, and unpredicted result of easy transportation without disassembly.

In a non-limiting exemplary embodiment, the plurality of media display members (surfaces) 21 include: a TV mount 21*a*, a peg board 21*b*, a dry-eraser board 21*c*, a cork board 21*d*, a white board 21*e*, and a magnetic board 21*f*. Such a structural configuration yields the new, useful, and unpredicted result of interchangeably swapping the media display members 21, as needed.

The present disclosure further includes a method of utilizing an easel 20 configured to selectively support a variety of media (via media display members). Such a method includes the initial step of: providing an easel 20 including a centrally registered longitudinal axis 22, a first display section 23 oriented along a first plane 24 obliquely angled to the centrally registered longitudinal axis 22, a second display section 25 opposed from the first display section 23 and oriented along a second plane 26 obliquely angled to the centrally registered longitudinal axis 22, and a plurality of storage shelves 27 positioned between the first display section 23 and the second display section 25. Advantageously, each of the first plane 24 and the second plane 26 are equidistantly offset from the centrally registered longitudinal axis 22. Such a structural configuration yields the new, useful, and unpredicted result of succinctly and interchangeably switch out various media display members 21 without have to disassemble the easel 20.

The method further includes the steps of: pivotally coupling the first display section 23 to the second display section 25; providing and removably engaging a plurality of media display members 21 with the first display section 23 and the second display section 25, respectively; positioning the media display members 21 parallel to the first plane 24 and the second plane 26, respectively; interchangeably and slidably engaging the media display members 21 with each of the first display section 23 and the second display section 25; and pivoting the first display section 23, relative to the second display section 25, about a fulcrum axis 29 perpendicular to the centrally registered longitudinal axis 22. Such method steps yield the new, useful, and unpredicted result of succinctly and interchangeably switch out various media display members 21 without have to disassemble the easel 20.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. An easel configured to selectively support a variety of media, said easel comprising:

a centrally registered longitudinal axis;

a first display section oriented along a first plane obliquely angled to the centrally registered longitudinal axis;

a second display section opposed from said first display section and oriented along a second plane obliquely angled to the centrally registered longitudinal axis;

a plurality of storage shelves positioned between said first display section and said second display section; and a plurality of media display members removably engaged with said first display section and said second display section, respectively, and positioned parallel to said first plane and said second plane, respectively;

wherein said plurality of media display members are interchangeably and slidably engaged with each of said first display section and said second display section;

wherein each of said first plane and said second plane are equidistantly offset from the centrally registered longitudinal axis;

wherein said first display section is pivotally coupled to said second display section;

wherein each of said first display section and said second display section is independently pivotal along a first arcuate path and a second arcuate path, respectively, relative to a fulcrum axis;

wherein said first display section includes a plurality of first rectilinear vertical legs equidistantly offset at opposed sides of the centrally registered longitudinal axis, a plurality of first rectilinear horizontal legs having axially opposed ends connected to said plurality of first rectilinear vertical legs, respectively, and a plurality of first guide rails statically coupled to axially opposed ends of said plurality of first rectilinear vertical legs, respectively;

wherein said plurality of first guide rails are oriented parallel to said plurality of first rectilinear horizontal legs and orthogonal to said plurality of first rectilinear vertical legs;

wherein said plurality of first guide rails are spaced from said storage shelves.

2. The easel of claim 1, wherein said second display section comprises:

a plurality of second rectilinear vertical legs equidistantly offset at opposed sides of the centrally registered longitudinal axis;

a plurality of second rectilinear horizontal legs having axially opposed ends connected to said plurality of second rectilinear vertical legs, respectively; and a plurality of second guide rails statically coupled to axially opposed ends of said plurality of second rectilinear vertical legs, respectively;

wherein said plurality of second guide rails are oriented parallel to said plurality of second rectilinear horizontal legs and orthogonal to said plurality of second rectilinear vertical legs.

3. The easel of claim 2, wherein said plurality of first guide rails comprises: a first top guide rail and a first bottom guide rail;

wherein said plurality of second guide rails includes a second top guide rail and a second bottom guide rail;

wherein said first top guide rail is pivotally coupled to said second top guide rail;

wherein said first bottom guide rail is spaced from said second bottom guide rail.

4. The easel of claim 3, further comprising: a plurality of casters attached to each of said first display section and said second display section.

5. The easel of claim 1, wherein said plurality of media display members comprise:

a TV mount, a peg board, a dry-eraser board, a cork board, a white board, and a magnetic board.

6. An easel configured to selectively support a variety of media, said easel comprising:

a centrally registered longitudinal axis;

a first display section oriented along a first plane obliquely angled to the centrally registered longitudinal axis;

a second display section opposed from said first display section and oriented along a second plane obliquely angled to the centrally registered longitudinal axis;

a plurality of storage shelves positioned between said first display section and said second display section; and a plurality of media display members removably engaged with said first display section and said second display section, respectively, and positioned parallel to said first plane and said second plane, respectively;

wherein said plurality of media display members are interchangeably and slidably engaged with each of said first display section and said second display section;

wherein each of said first plane and said second plane are equidistantly offset from the centrally registered longitudinal axis;

wherein said first display section is pivotally coupled to said second display section and pivoted about a fulcrum axis perpendicular to the centrally registered longitudinal axis wherein each of said first display section and said second display section is independently pivotal along a first arcuate path and a second arcuate path, respectively, relative to the fulcrum axis wherein said first display section comprises:

a plurality of first rectilinear vertical legs equidistantly offset at opposed sides of the centrally registered longitudinal axis;

a plurality of first rectilinear horizontal legs having axially opposed ends connected to said plurality of first rectilinear vertical legs, respectively; and a plurality of first guide rails statically coupled to axially opposed ends of said plurality of first rectilinear vertical legs, respectively;

wherein said plurality of first guide rails are oriented parallel to said plurality of first rectilinear horizontal legs and orthogonal to said plurality of first rectilinear vertical legs;

wherein said plurality of first guide rails are spaced from said storage shelves.

7. The easel of claim 6, wherein said second display section comprises:

a plurality of second rectilinear vertical legs equidistantly offset at opposed sides of the centrally registered longitudinal axis;

a plurality of second rectilinear horizontal legs having axially opposed ends connected to said plurality of second rectilinear vertical legs, respectively; and a plurality of second guide rails statically coupled to axially opposed ends of said plurality of second rectilinear vertical legs, respectively;

wherein said plurality of second guide rails are oriented parallel to said plurality of second rectilinear horizontal legs and orthogonal to said plurality of second rectilinear vertical legs.

8. The easel of claim 7, wherein said plurality of first guide rails comprises: a first top guide rail and a first bottom guide rail;

wherein said plurality of second guide rails includes a second top guide rail and a second bottom guide rail;

wherein said first top guide rail is pivotally coupled to said second top guide rail;

wherein said first bottom guide rail is spaced from said second bottom guide rail.

9. The easel of claim 8, further comprising: a plurality of casters attached to each of said first display section and said second display section.

10. The easel of claim 6, wherein said plurality of media display members comprise:

a TV mount, a peg board, a dry-eraser board, a cork board, a white board, and a magnetic board.

* * * * *